US012467665B2

(12) United States Patent
Johnson

(10) Patent No.: US 12,467,665 B2
(45) Date of Patent: Nov. 11, 2025

(54) ACCLIMATIZED LIQUID POWERED DUAL CIRCUIT HEAT PUMP

(71) Applicant: Heat Source Energy Corp., American Fork, UT (US)

(72) Inventor: Keith Sterling Johnson, American Fork, UT (US)

(73) Assignee: Heat Source Energy Corp., American Fork, UT (US)

( * ) Notice: Subject to any disclaimer, the term of this patent is extended or adjusted under 35 U.S.C. 154(b) by 0 days.

(21) Appl. No.: 19/232,339

(22) Filed: Jun. 9, 2025

(65) Prior Publication Data

US 2025/0305729 A1 Oct. 2, 2025

Related U.S. Application Data

(63) Continuation of application No. PCT/US2023/083240, filed on Dec. 8, 2023.

(60) Provisional application No. 63/386,818, filed on Dec. 9, 2022.

(51) Int. Cl.
*F25B 30/02* (2006.01)

(52) U.S. Cl.
CPC ..... *F25B 30/02* (2013.01); *F25B 2400/07* (2013.01)

(58) Field of Classification Search
CPC ..... F25B 30/02; F25B 2400/07
See application file for complete search history.

(56) References Cited

U.S. PATENT DOCUMENTS

| | | | | |
|---|---|---|---|---|
| 2006/0065217 | A1 | 3/2006 | Ikegawa | |
| 2017/0002808 | A1 * | 1/2017 | Gong | F04B 39/123 |
| 2017/0008407 | A1 | 1/2017 | Porras | |
| 2018/0017292 | A1 | 1/2018 | Yana Motta | |
| 2021/0164700 | A1 | 6/2021 | Cao | |

FOREIGN PATENT DOCUMENTS

DE 3002815 A1 * 1/1980

OTHER PUBLICATIONS

DE-3002815-A1 translation.*
International Search Report and Written Opininon regarding International Application No. PCT/US23/83240, mailed May 16, 2024.

* cited by examiner

*Primary Examiner* — Elizabeth J Martin
(74) *Attorney, Agent, or Firm* — Miller Johnson

(57) ABSTRACT

An example heat pump system includes a first circuit including a first refrigerant configured to cycle a non-mechanical liquid to high critical vapor fluid phase in a closed circuit from an evaporator to an outlet of a liquid pump and a second circuit comprising a second refrigerant. The second circuit is configured to extract thermal energy from the first circuit to produce a heated fluid and a cooled fluid. The first circuit and the second circuit are configured in a mechanical relationship for transferring energy from the first circuit to the second circuit via a phase change of the first refrigerant through a dual chambered heat pump, the first circuit including a non-mechanical phase liquid to high critical vapor fluid phase.

20 Claims, 13 Drawing Sheets

ACCLIMATIZED LIQUID POWERED DUAL CIRCUIT HEAT PUMP

CROSS-REFERENCE TO RELATED APPLICATIONS

This application is a continuation of PCT International Application No. PCT/US23/83240 filed Dec. 8, 2023, which claims priority to U.S. Provisional Patent Application No. 63/386,818, filed Dec. 9, 2022. The entire disclosures of the above applications are incorporated by reference.

BACKGROUND

Technologies currently exist to control environmental conditions of an enclosed space. These technologies range from simple evaporative systems, which provide cooling in an enclosed space by evaporation of water from a fixed media, to more advanced techniques that employ more sophisticated air-conditioning technology.

In traditional air conditioning systems employed for many years in commerce, a refrigerant, normally consisting of a Freon compound (carbon compounds containing fluorine and chlorine or bromine), in a volatile liquid form, is passed through a set of evaporator coils located in the space to be cooled. The refrigerant evaporates and, in the process, absorbs the heat contained in the air in the enclosed space. When the cooled air reaches its saturation point, its moisture content condenses. The condensate then can drain. The cooled and dehumidified air is returned into the room by means of a blower. During this process, vaporized refrigerant passes into a compressor where it is pressurized and forced through condenser coils, which are in contact with the outside air. Under these conditions, the refrigerant condenses back into a liquid form and gives off the heat it absorbed inside the enclosed space. This heated air is expelled to the outside, and the liquid recirculates to the evaporator coils to continue the cooling process.

In some units, the two sets of coils can reverse functions so that in winter, the inside coils condense the refrigerant and heat rather than cool the room or enclosed space. These units are referred to as a "heat pump." Both the above described traditional mechanical refrigeration air conditioning systems and heat pumps require work in the form of the energy required to operate the associated mechanical compressor in the systems. Although air-conditioning units of these types are widely used in the industry, they are typically relatively expensive to operate and use relatively large amounts of electrical power.

Even though heat pump technology using the reversible flow of a compressible refrigerant has been available for many years, the existing heat pump systems have not taken advantage of advanced systems configured for more efficient pumping of refrigerant and improved materials that can translate into significant power consumption savings.

Thus, users and manufacturers of heat and cooling systems continue to seek new and improved devices, systems, and methods for heat transfer.

SUMMARY

In at least one embodiment of the present disclosure, a heat pump is disclosed. The heap pump includes a first circuit including a first refrigerant configured to cycle a non-mechanical liquid to high critical vapor fluid phase in a closed circuit from an evaporator to an outlet of a liquid pump. The heat pump includes a second circuit comprising a second refrigerant, wherein the second circuit is configured to extract thermal energy from the first circuit to produce a heated fluid and a cooled fluid. The first circuit and the second circuit are configured in a mechanical relationship for transferring energy from the first circuit to the second circuit via a phase change of the first refrigerant through a dual chambered heat pump, the first circuit including a non-mechanical phase liquid to high critical vapor fluid phase.

In at least one embodiment of the present disclosure, a piston system is disclosed. The piston system includes a Polytetrafluoroethylene (PTFE) stator tube and a linear motion piston disposed in the PTFE stator tube. The linear motion piston includes at least one PTFE seal disposed between the stator tube and the linear motion piston. The piston system is configured to operate free of lubrication.

In at least one embodiment if the present disclosure, a liquid powered dual circuit heat pump system is disclosed. The liquid powered dual heat pump system includes a first circuit having a closed thermodynamic cycle energy system including a CO2 working fluid, the first circuit comprising a linear piston compressor, an evaporator, an expansion tank, and a condenser in series. The liquid powered dual circuit heat pump system further includes a second circuit comprising a heat pump system including a 1234yf gas working fluid, the second circuit comprising a linear piston compressor, a hot tank, an evaporator, and a condenser in series. The liquid powered dual circuit heat pump system includes a heat exchanger that converts the CO2 working fluid from a liquid at an inlet of the heat exchanger to a vapor at an outlet of the heat exchanger, wherein the inlet of the heat exchanger and the outlet of the heat exchanger are configured to maintain an equal pressure.

In at least one embodiment of the present disclosure, a heat pump system is disclosed. The heat pump system includes a decompression system connected to a compression system, wherein the decompression system and the compression system include pressure shells and are connected together with a magnetic coupling and a gear. The gear includes a decompressor comprising a first scroll, the decompression system including a high-pressure refrigerant. The high-pressure refrigerant drives a compressor comprising a second scroll, the compression system including a low pressure refrigerant.

In at least one embodiment of the present disclosure, method of operating a heat pump system is disclosed. The method includes utilizing heat energy absorbed from wasted heat of other thermal systems to power a high pressure refrigerant through a pressure boosting and pressure reducing process. The method includes producing a differential pressure energy from the pressure boosting and pressure reducing process. The method includes driving a compression process configured to heat a low pressure refrigerant.

In at least one embodiment of the present disclosure, a heat pump system is disclosed. The heat pump system can be configured to transfer heat between vehicle components. In some examples, the heat pump system can include a first circuit having a first refrigerant and a second circuit having a second refrigerant. In some examples, the second circuit is configured to extract thermal energy from the first circuit. The first circuit and the second circuit can be configured in a mechanical relationship for transferring energy from the first circuit to the second circuit via a phase change of the first refrigerant through the dual circuit heat pump, the first circuit including a non-mechanical phase liquid to high critical vapor fluid phase.

In at least one embodiment of the present disclosure, a method of transferring heat between vehicle components can include utilizing heat energy absorbed from wasted heat of a vehicle component to drive a refrigerant through a first circuit comprising a pressure boosting and pressure reducing process. The method can also include producing a differential pressure energy from the first circuit to drive a compression process in a second circuit comprising a second refrigerant. The method of transferring heat between vehicle components can further include utilizing the compression process to transfer heat energy or add mechanical energy to a second vehicle component.

BRIEF DESCRIPTION OF THE DRAWINGS

The drawings illustrate several embodiments of the present disclosure, wherein identical reference numerals refer to identical or similar elements or features in different views or embodiments shown in the drawings.

DETAILED DESCRIPTION

Embodiments disclosed herein are related to assemblies, systems, and methods of using heat transfer assemblies and systems. A heat transfer system can operate by pumping an acclimatized cool high pressure liquid refrigerant through a non-mechanical heat exchanger, which increases the volume of the high pressure liquid while retaining an equal vapor pressure. The system increases the energy for pumping heat in a dual refrigerant circuit liquid to vapor heat pump process.

The nature of the present disclosure and the various features and advantageous details thereof are explained more fully with reference to the non-limiting examples that are illustrated in the accompanying drawings and detailed in the following description. The examples used are intended merely to facilitate an understanding of ways in which the systems and methods described may be practiced according to the various embodiments of the invention. Accordingly, the examples should not be construed as limiting the scope of the disclosure.

Figure 1A:
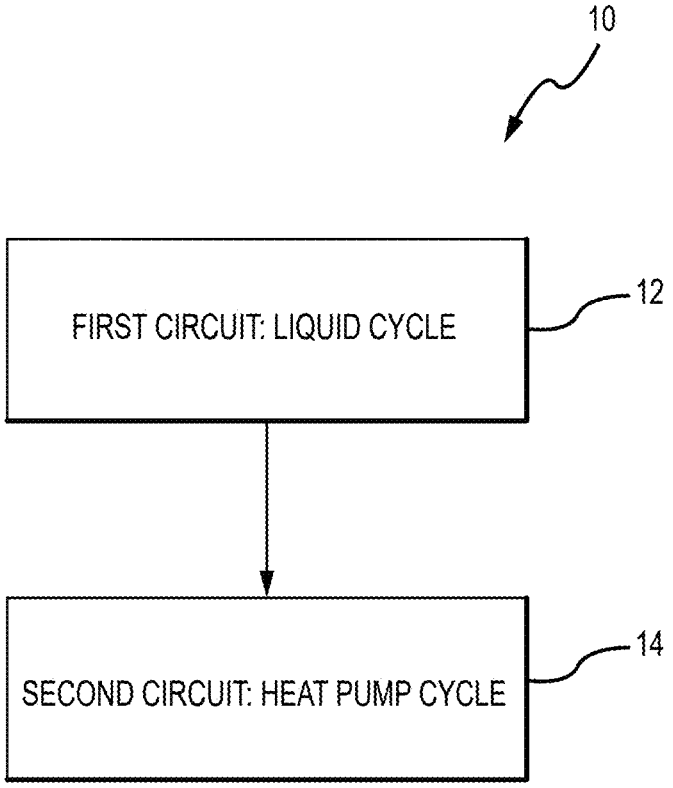
FIG. 1A illustrates a simplified block diagram of a dual circuit heat pump system, according to an embodiment.

Referring to FIG. 1A, in some examples, a heat pump system 10 can include a closed thermodynamic cycle energy system 12, referred to herein as a first circuit. In some examples, the first circuit can include a working fluid circulating through a closed cycle fluid path. In some examples, the first circuit can include at least a heat exchanger, a vapor pressure force piston chamber, and a compressor(s) (not shown). Energy can be generated by pumping the working fluid as a high pressure liquid through the heat exchanger, which converts the liquid into a vapor. The conversion of liquid to vapor increases the working fluid volume significantly, thereby increasing the energy to a second circuit 14 of the heat pump system 10, the second circuit being connected to the closed cycle. The heat pump system 10 is configured to extract thermal energy from the working fluid. The heat pump system 10 may then transfer thermal energy to a plurality of heat stores, including a heating system or a cooling system, which can obtain work from the heat pump system 10.

Figure 1B:
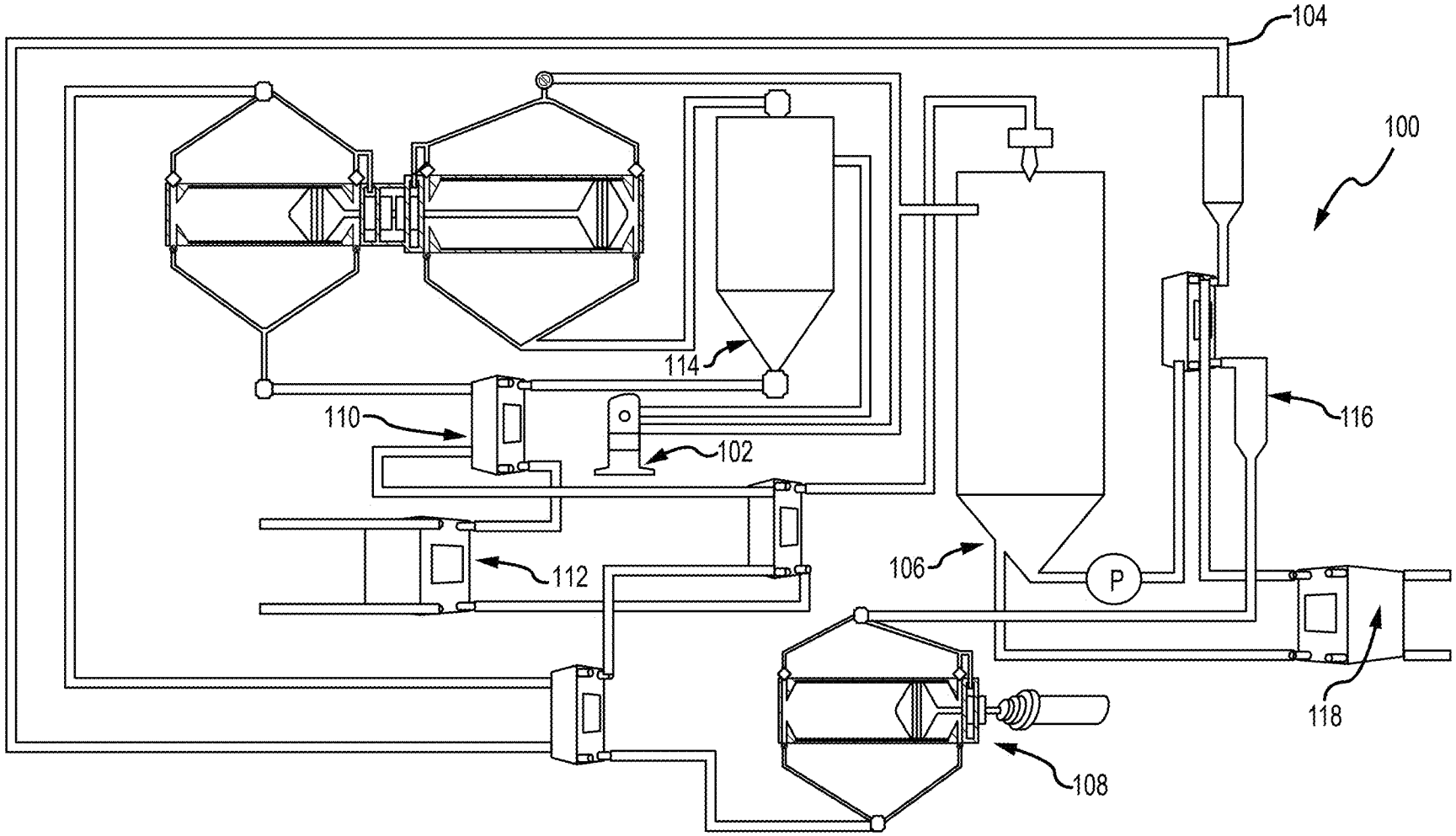
FIG. 1B illustrates a simplified schematic representation of an acclimatized liquid powered dual circuit heat pump system, according to an embodiment.

FIG. 1B illustrates an acclimatized liquid powered dual circuit heat pump system 100, according to some embodiments. The heat pump system 100 operates as described above in FIG. 1A. In some examples, the term "refrigerant" is intended to describe any compressible and expandable refrigerant configured for use in a closed circuit to achieve a cooling and/or heating effect by the liquid/vapor phase change of the compressible and expandable refrigerant. The refrigerant, as used herein, is descriptive of a general class of refrigerants or low and high pressure refrigerant combinations that may be incorporated into the systems described herein. Thus, a number of compressible refrigerants of the same general class will be known to those skilled in the relevant industries and that the term refrigerant is used in the discussion which follows merely as a shorthand for describing this general class of refrigerants.

As shown in FIG. 1B, a small startup compressor 102 can be included to acclimatize the refrigerant in a first circuit 104. In some examples, the compressor 102 can be a ¼ ton compressor. The startup compressor 102 can be configured to initiate the heat pump system 100. Generally, starting a compressor requires a high electrical load. The small startup compressor 102 can assist the system 100 to overcome the mechanical inertia upon startup to reduce system wear and extend the life of the system as well as condition the refrigerant from an equal temperature pressure state into a more powerful thermodynamic state. In other words, the delta T ($\Delta T$) and delta P ($\Delta P$) can be improved by allowing a refrigerant (e.g., CO2) differential pressure force in the first circuit 104 to be used via a linear connected piston (described below in FIG. 3) to compress the refrigerant, such as R-1234yf refrigerant into a hot and cool gas, which then supplies primary heating and cooling to all internal and external circuits.

The startup compressor 102 can be configured to create a cold acclimatized liquid in first circuit 104 and second circuit 106. In some examples, the startup compressor 102 can then be turned off upon initiating a first circuit liquid pump 108, which circulates a condensed liquid refrigerant. In other words, after initiating the system, including both the first circuit 104 and the second circuit 106, the start-up acclimatizing compressor 102 may be shut off when the liquid pump 108 starts to circulate the acclimatized and/or condensed liquid refrigerant, wherein the second circuit compressor/piston takes over maintaining a hot and cold acclimated condition of both circuits, not requiring the work of the startup compressor 102.

As noted above, the refrigerant of the first circuit 104 may be CO2. CO2 has a boiling point of −108° F. (−77.8° C.), a critical temperature of 87° F. (30.5° C.), and a critical pressure of 1,070 psi (7.38 MPa). The use of CO2 or R-744 Refrigerant and R-1234yf may be shown and described, however many other types of the first circuit and the second circuit refrigerant combinations may be incorporated (e.g., R-1234yf and R-1234ze or CO2 and nitrogen). For example, for deep freezing or cryogenic freezing embodiments, Nitrogen may be used in the first circuit and CO2 may be used in the second circuit. The first circuit can include the "power cycle" circuit 104 or first loop, which is configured to increase the energy for pumping heat in the second circuit 106. The second circuit 106 or loop includes a heat pump system.

In some examples, the assemblies, systems, and methods of using heat transfer assemblies and systems can include a linear motion piston pump, such as first circuit liquid pump 108, configured to move a liquid refrigerant at a relatively low speed and negligible slippage. The pump can operate at a low rotation per minute (RPM) or cycle speed, between about 1 and about 120 RPM in some examples, allowing for a more efficient pumping of refrigerant in both a liquid phase and a vapor phase, while keeping lubricating oil out of the system for better heat transfer. The piston pump uses little energy compared to a vapor compressor or a vapor pump known in the art. In some examples, the start-up compressor 102 can be used to acclimatize the first circuit 104, which creates a cold acclimatized liquid in both the first circuit 104 and the second circuit 106.

The first circuit liquid pump 108 can be a linear motion piston pump producing about 25,000 pounds (111.2 kN) of force to pump the liquid refrigerant. Refrigerant compressors are generally configured to compress a cool gas to a hot gas, which requires relatively higher amounts of energy to move vapor compared to the lower energy required to move liquid. The first circuit liquid pump 108 uses significantly less energy, between about 50% and about 90% less in some examples, when compared to a vapor pump. In some examples, a linear piston pump can be configured to pump without lubrication using low friction seals and low friction pistons in low friction chambers.

In some examples, a non-mechanical liquid to high critical vapor volume can be pushed from an evaporator 110 in the first circuit 104 at equal pressure to the outlet of the liquid pump 108. In other words, the first circuit 104 includes a non-mechanical phase liquid to high critical vapor fluid phase. Equal pressure at the inlet and outlet of a heat exchanger 112 in liquid to vapor phases require much less heat pumping energy than a typical vapor-to-vapor compressor. In some examples, the push power can come from a low-volume-liquid to high-volume-vapor phase change in the evaporator 110 disposed in the first circuit. Thus, by absorbing a portion of the system's heat, the evaporator 110 can act as a non-mechanical low volume liquid to high volume super-heated vapor "booster pump" for the heat pump system 100.

In some examples, the liquid pump 108 and the evaporator 110 in the first circuit 104 can replace the burden of electrical consumption of a comparative vapor compressor required to move refrigerant vapor from a cool gas to a hot gas through a typical compressor driven heat pump system, which translates into a large savings in power consumption. In some examples, the first refrigerant includes a refrigerant with a boiling point below −30° C. Because carbon dioxide (CO2, or R-744) boils at about −108° F. (−77.8° C.), but can only be a liquid at below 87° F. (30.6° C.), when it expands to a critical vapor at 140° F. (60° C.), the carbon dioxide (CO2) causes a tremendous vapor pressure volume power increase at a closer ΔT than low-pressure refrigerants (e.g., R-1234yf or R-1234ze).

Second circuit 106 can include a lower pressure system and a different refrigerant than first circuit 104. In some examples, second circuit 106 can use an R-1234yf refrigerant. 1234*yf* has a boiling point of −22° F. or −20° C., a critical temperature of 202° F. (94.4° C.), and a critical pressure of 527 psi (3.63 MPa). In other examples, the second refrigerant can include a 1234ze refrigerant. Second circuit 106 can be coupled to both the hot water loop 114 for heating and the cold water loop 116 for cooling at heat exchanger 112 or a heat exchange system that includes at least one heat exchanger. The heat exchanger 112 or evaporator 110 can be a 5 ton heat exchanger, in some examples. Within the heat exchanger 112, the low volume liquid can be converted by phase change to a high volume vapor. As such, the heat exchanger 112 can function as a non-mechanical booster pump. In other words, the heat exchanger system 112 can be both capable of acting as either an evaporator or a condenser and adapted to absorb thermal energy from a structure in a cooling mode and supply thermal energy to the structure in a heating mode. In some examples, the evaporator 110 can further vaporize the first refrigerant. Each of the systems and components that make up the heat pump system 100 are described in greater detail below.

Figure 2:
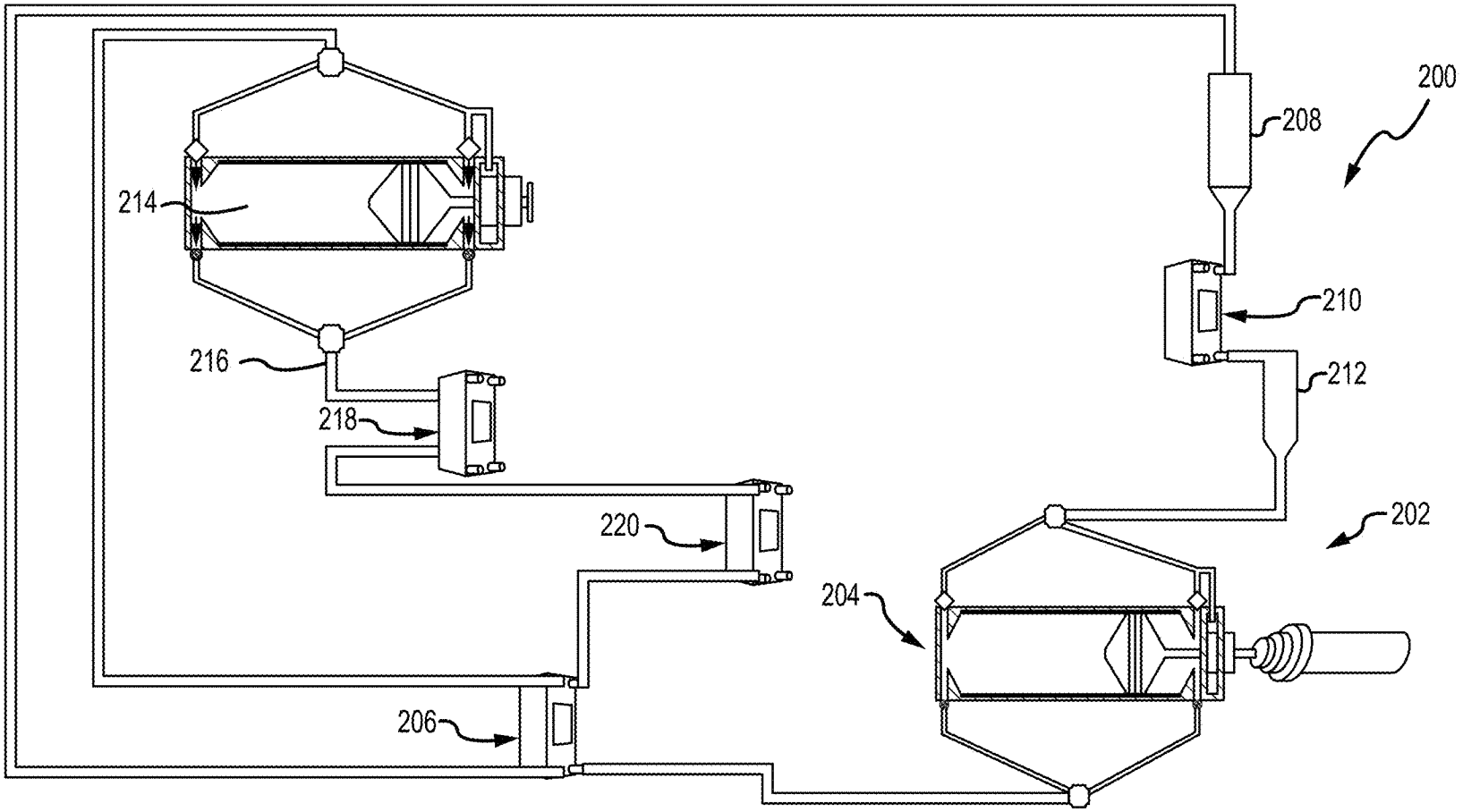
FIG. 2 illustrates a first circuit of the heat pump system shown in FIG. 1B.

FIG. 2 illustrates a first circuit 200 of the heat pump system 100 shown in FIG. 1B. The first circuit 200 may be the same as the first circuit identified as reference 12 and 104 in FIGS. 1A-1B. The first circuit 200 illustrates and is configured to carry out the first refrigerant (e.g., CO2) cycle that supports the heat pump system. First circuit 200 can include a CO2 liquid cycle 202 that includes the CO2 liquid pump 204, an exhaust recuperator 206, an expansion tank 208, a condenser 210, and a liquid tank 212 configured to feed the CO2 liquid pump 204. In some examples, the CO2 liquid pump 204 can pump the CO2 liquid to a discharge having about 1840 psi (12.69 MPa) and about 45° F. (7.2° C.) into the exhaust recuperator 206. The recuperator 206 is a device used to reclaim heat energy from the second circuit cycle (not shown). In other words, the recuperator 206 is a heat exchanger that uses residual heat from a CO2 exhaust gas system in order to retain some heat in first circuit 200. The recuperator 206 improves energy efficiency, which can reduce costs associated with heating or manufacturing. The recuperator 206 is a heat exchanger that uses residual heat from a CO2 gas system to convert the liquid CO2 to a vapor. The first refrigerant (e.g., CO2) exits the recuperator 206 at about 85° F. (29.4° C.) and about 597 psi (4,116 KPa), in some examples. The CO2 exit stream feeds into the CO2 vapor power piston chamber 214 of first circuit 200, the CO2 vapor power piston chamber 214 is described further below in reference to FIG. 3. The discharge 216 of the CO2 vapor power piston chamber can be at about 140° F. (60° C.) and 1,840 psi (12.69 MPa). The discharge 216 of the CO2 vapor power piston chamber feeds into a 1 ton CO2 evaporator 218. The liquid refrigerant expands by a pressure reduction and is fed to the CO2 expansion tank 208 and then the CO2 condenser 210 for condensing back into liquid CO2 and thereby evaporating itself. The liquid CO2 is stored in the storage tank 212 and the CO2 liquid can then be fed to the CO2 liquid pump 204 to complete the cycle.

The evaporator 218 exchanges heat through the first circuit 200 and converts the CO2 liquid into a gas or vapor. In some examples, the evaporator 218 can include a shell and tube heat exchanger, allowing for easy non-mechanical operation. In some examples, the evaporator 218 can range from 10 kilowatts (KW) to about 100 KW. A vapor phase first refrigerant (e.g., CO2) enters the refrigerant condenser 210 where it is liquefied using a liquid refrigerant. The evaporated vapors of a second refrigerant then are led to the suction of a refrigeration compressor (not shown in FIG. 2) where they are compressed to a higher pressure. This superheated vapor refrigerant is then sent to a preheater 220. In some examples, the inlet to the preheater 220 can include a CO2 gas at about 110° F. (43.3° C.) and 1,840 psi (12.69 MPa). The purpose of the preheater 220 is to add heat to (i.e., recover the heat from) the CO2 gas system, which increases the thermal efficiency of the recuperator 206 by reducing the heat loss in the CO2 vapor phase. In some examples, the outlet of the preheater 220 can include a CO2 gas at about 65° F. (18.3° C.) and 1,840 psi (12.69 MPa), which is also an inlet to the recuperator 206. In some examples, a second outlet of the recuperator 206 is a CO2 vapor at about 65° F. (18.3° C.) and about 597 psi (4.12 MPa). This CO2 vapor can be sent to the CO2 expansion tank 208, which improves condensing of the CO2 because of natural expansion of the CO2 in the expansion tank 208. The expansion tank 208 protects the first circuit from excessive pressures by regulating and controlling the expansion of the first refrigerant. In some examples, the expansion tank 208 can be configured to operate at about 45° F. (7.22° C.) and about 597 psi (4.12 MPa). The CO2 is then sent from the expansion tank to the CO2 condenser 210, where the CO2 vapor is condensed to a CO2 liquid state at a vapor saturation configured for liquid pumping without cavitation and sent to the CO2 liquid tank 212 to feed the CO2 liquid pump 204.

Figure 3:
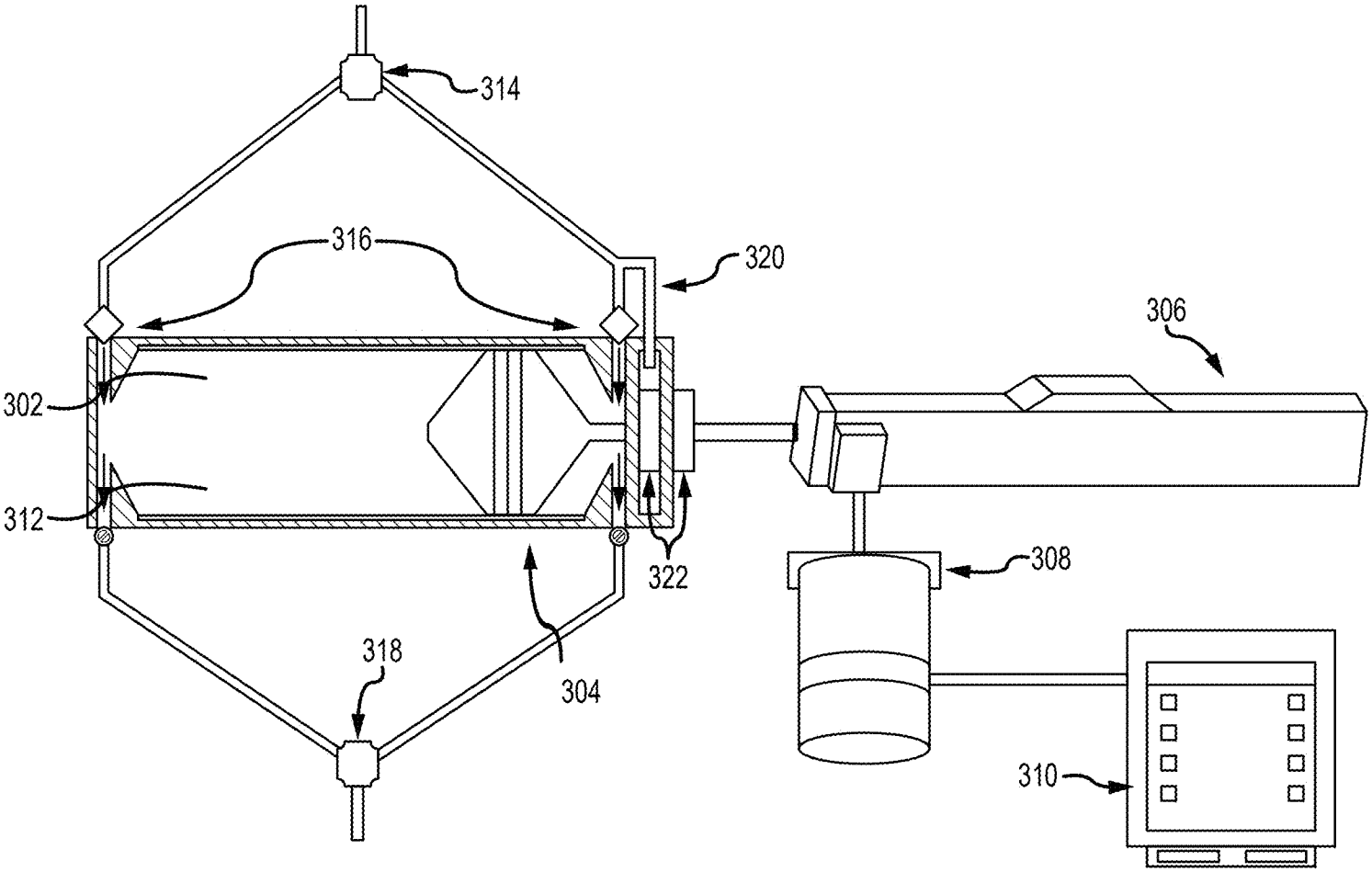
FIG. 3 illustrates a carbon dioxide vapor pressure force piston chamber of the first circuit shown in FIG. 2.

FIG. 3 illustrates a CO2 vapor pressure force piston chamber 302 of the first circuit shown in FIG. 2. In some examples, the CO2 vapor pressure force piston 304 head can be conically shaped or in the shape of a dome to increase the surface area of the piston 304. The shape of the piston 304 head can be configured as such to achieve higher push forces from the piston chamber's 302 entering vapor forces such as about 1000 psi (6.89 MPa) to about 1840 psi (12.69 MPa). The vapor pressure force piston chamber 302 can be configured to operate at between about 37 to about 120 cycles per minute, in order to optimize the thermal transfer of the heat pump system. The vapor pressure force piston chamber 302 can be a linear motion piston chamber. The vapor pressure force piston chamber 302 can produce about 36,000 pounds of force (160 kN). In some examples, the shaft of the vapor pressure force piston chamber can be coupled to a motor or generator 304 through a linear motion to rotational motion gear box 306. The motor or generator 308 can drive a load 310. In some examples, the load 310 can be a portion (e.g., 5%-50%) of the motor or generator's 308 work as electricity, and/or be used to operator a second compressor. In some examples, the load 310 can include a load cell configured to measure shaft power.

In some examples, the vapor pressure force piston chamber 302 can include about a six inch chamber 312 housing the piston. The refrigerant (e.g., CO2) can enter the vapor pressure force piston chamber 302 as a superheated-supercritical high pressure gas at between 800-2000 psi (3.45 MPa-13.79 MPa). The gas can enter through a 3-way valve or an electrical solenoid 314. In some examples, the 3-way valve 314 can include a stepper motor. The stepper motor is a brushless DC electric motor that divides a full rotation into a number of equal steps. The motor's position can be commanded to move and hold at one of these steps without any position sensor for feedback, or in other words configured as an open-loop controller. In some examples, the gas can then pass through a check valve 316 prior to entering the piston chamber 312. The check valve 316 can be a ¾ in (1.9 cm) check valve, in some examples. The high pressure CO2 gas can then exit the chamber through a second 3-way valve 318. The second 3-way valve 318 can also include a stepper motor. Upon exiting the second 3-way valve 318, the CO2 gas is at a lower pressure such as 597 psi (4.11 MPa) because of a pressure drop from CO2 gas expansion, cooling and condensing at the outlet of the piston chamber 312.

The vapor pressure force piston chamber 302 can also include a primary seal leakage bypass line 320 to bypass the check valve 316, in some examples. The piston 304 can be coupled to a shaft that includes at least two linear mechanical seals 322 to seal the chamber 312 from the motor 308. The vapor pressure force piston chamber 302 can be configured to generate a net extra force on vapor compression. In some examples, for a CO2 gas, the vapor pressure force piston chamber 302 can operate with about a 1,250 psi (8.62 MPa) differential pressure and about 36,000 pounds of force that translates in 1.62 seconds per revolution. In some examples, the vapor pressure force piston chamber 302 can generate about 29,866 Watts of energy in the vapor.

Figure 4:
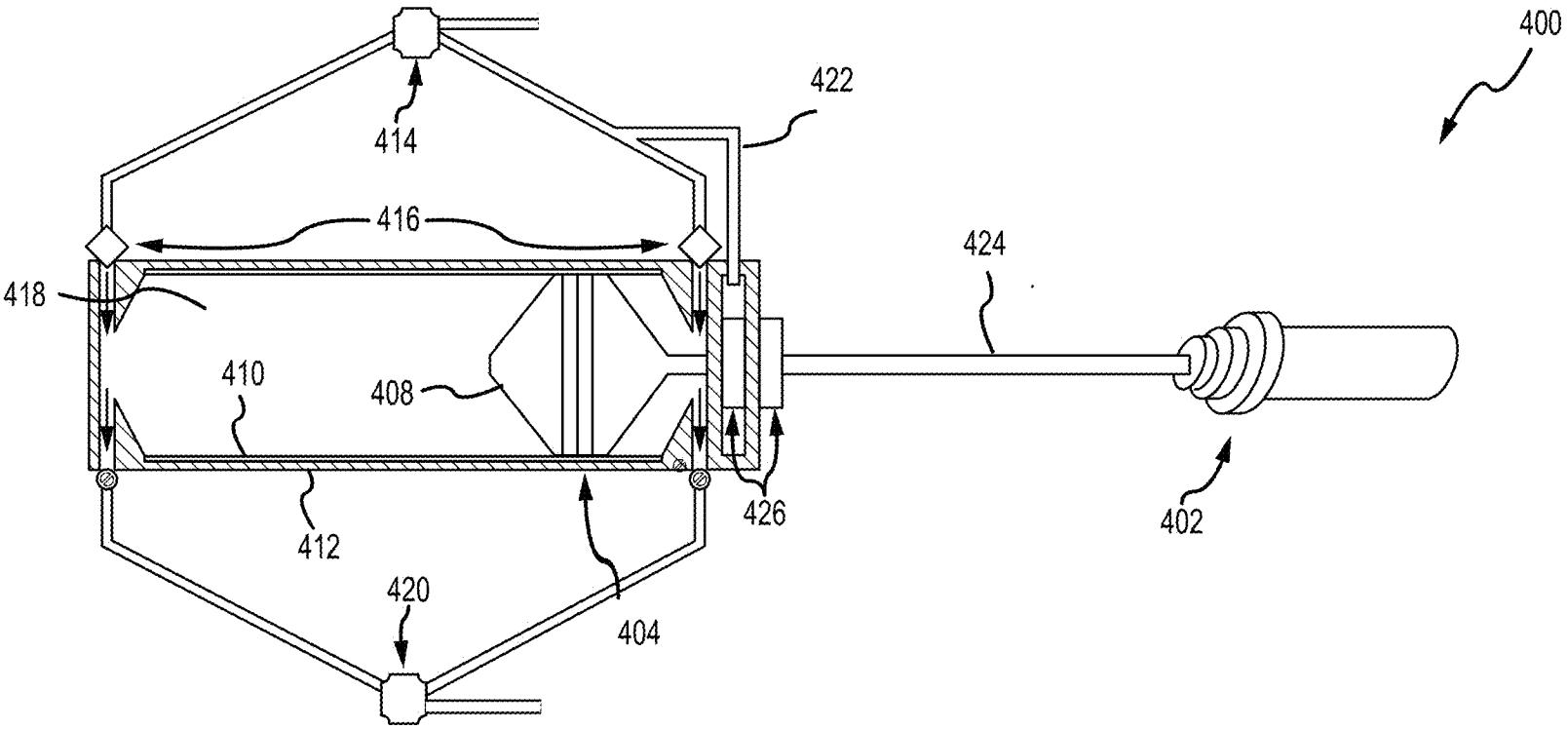
FIG. 4 illustrates a carbon dioxide liquid pump of the first circuit shown in FIG. 2.

FIG. 4 illustrates a carbon dioxide liquid pump 400 of the first circuit shown in FIG. 2. The carbon dioxide liquid pump 400 can be the same pump and/or have the same components of liquid pump 108 of FIG. 1B and liquid pump 204 of FIG. 2. The liquid pump 400 can be configured to operate at between about 1 to about 20 cycles per minute. The liquid pump 400 can be a linear motion piston pump. The pump 400 can include an integrated alternating pole DC piston motor. For example, in some embodiments, the piston can include neodymium linear magnets 404 disposed on the piston 408 and the linear stator can be embedded into a Teflon sleeve 410 disposed in the chamber wall 412. The pump 400 can produce about 36,000 pounds of force. In some examples, the piston pump 400 can be coupled to a hydraulic oil pump 402. The oil pump 402 can be a hydraulic pump configured to push about one gallon per minute. In some examples, the oil pump 402 can operate at about 1,250 psi (8.62 MPa). The oil pump 402 can include about a six inch (15.24 cm) push-pull hydraulic cylinder and require about 600 Watts to operate.

In some examples, the liquid pump 400 can include about a six inch chamber housing the piston. The CO2 can enter the liquid pump 400 as a low pressure suction condensed liquid at about 597 psi (4.12 MPa). The liquid can enter through a 3-way valve 414 or solenoid. In some examples, the 3-way valve 414 can include a stepper motor. In some examples, the liquid CO2 then passes through a check valve 416 prior to entering the piston chamber 418. The check valve 416 can be a ¾ in check valve, in some examples. The high pressure CO2 liquid can then exit the chamber through a second 3-way valve 420 or solenoid. The second 3-way valve 420 can also include a stepper motor. Upon exiting the second 3-way valve 420 or solenoid, the CO2 liquid is at a high pressure at about 1,840 psi (12.69 MPa) because of the heat added ahead in its flow path in the preheater (as shown in FIG. 2) and evaporator (shown in FIG. 2) and at about 45° F. (7.2° C.) (about the same temperature) because the pure unsaturated liquid is not compressible when pumped and has not absorbed any heat at this point of pumping. The CO2 liquid is at 1840 psi (12.69 MPa) because of the heat absorbed in the preheater and evaporator. The heat also increases the pressure that is applied against the pump 400 and against the vapor pressure force piston chamber (214 of FIG. 2) in first circuit. The pump 400 is not configured to increase pressure, but to circulate the pressure added by heat after pumping and/or circulating occurs. For example, within the CO2 evaporator a non-mechanical increase in pressure occurs, and the pressure increases. Also, within the CO2 condenser a non-mechanical decrease in pressure occurs. Thus, the pressure differential of about 1,250 psi (8.62 MPa) provides the energy to compress the low pressure refrigerant (1234yf) in the second circuit.

The liquid pump 400 can also include a primary seal leakage bypass line 422 to bypass the ¾ inch (1.9 cm) check valve, in some examples. The piston 408 is coupled to a shaft 424 that includes at least two linear mechanical seals 426 to seal the 6 inch (15.24 cm) chamber 418 from the pump. The pump 400 can be configured to generate a small net extra force on liquid. In some examples, for a CO2 liquid, the pump 400 can operate with about a 1,250 psi (8.62 MPa) differential pressure and about 36,000 pounds of force that translates in about 1 RPM. The pump 400 can generate about 600 Watts of energy in the liquid at about 1 RPM.

Figure 5:
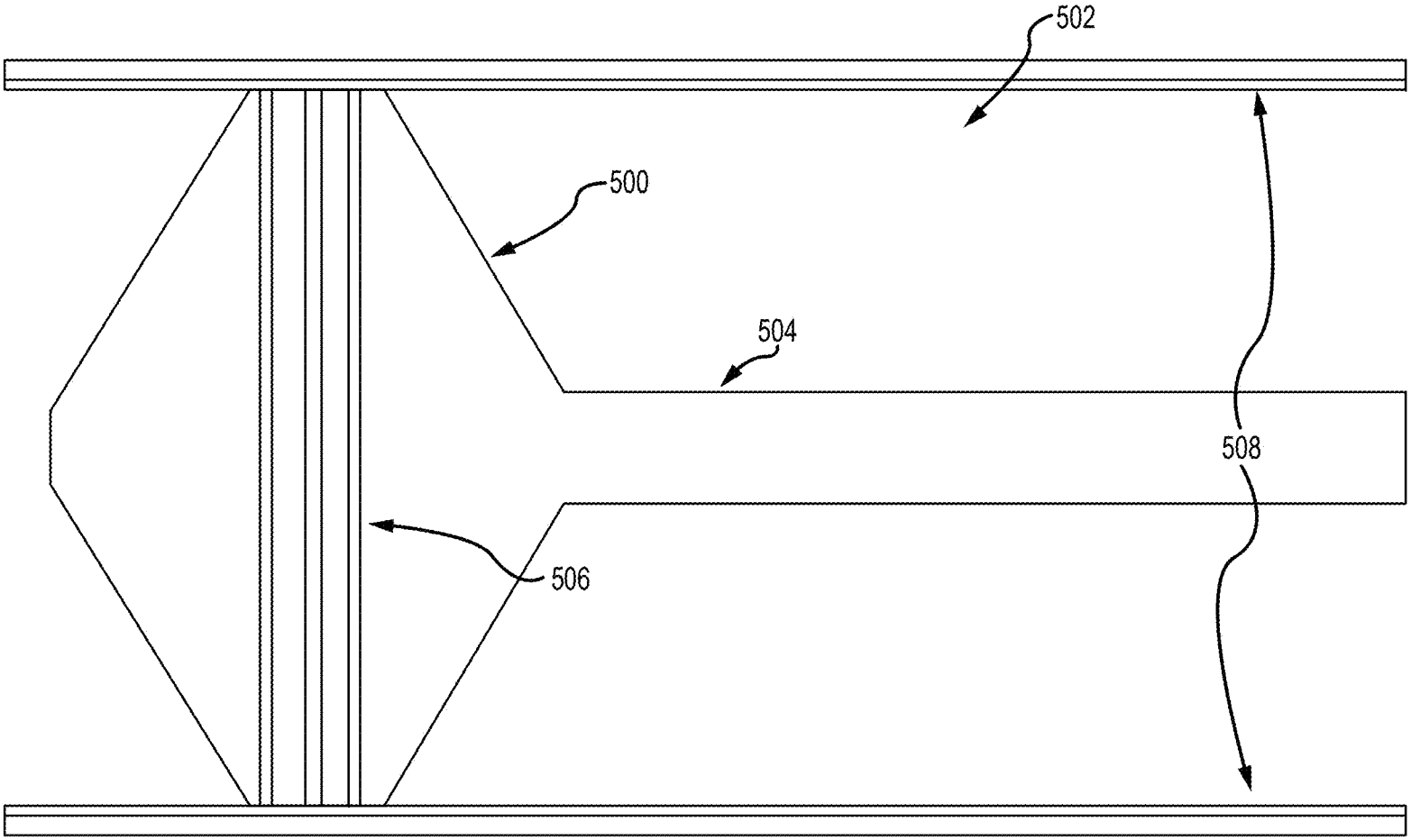
FIG. 5 is a cross-sectional view of an example piston and piston chamber, according to some embodiments.

FIG. 5 is a cross-sectional view of an example piston 500 and piston chamber 502, according to some embodiments. Similar or identical pistons and chambers are included in each of the pumps and/or vapor pressure force piston chambers disclosed. In some examples, the piston 500 can be formed of a steel material and include about a 40° angle on each side of the piston in a dome shape or conical shape. The piston 500 can include a shaft 504 that is connected to a motor or generator (not shown). The shaft 504 can be coated with a polytetrafluoroethylene (PTFE) to improve friction and so the piston 500 can pump without an oil lubrication. The piston 500 further includes PTFE seals 506 or rings to ensure a proper, fluid-tight seal and can also be coated with PTFE in some examples. In some examples, the piston 500 can include neodymium magnets disposed thereon and the stator sleeve includes copper windings embedded in a Teflon sleeve disposed in a chamber wall of the piston motor to produce electricity as parallel work to vapor compression performed by the linear motion piston pump. The piston 500 can be disposed in a PTFE low friction stator tube 508 that can be inserted into a high pressure cylinder or PTFE coating. With this design, the linear pump and compressor can allow for an efficient pumping of refrigerant in both a liquid phase and a vapor phase while keeping lubricating oil out of the system, which can provide a more efficient heat transfer.

Figure 6A:
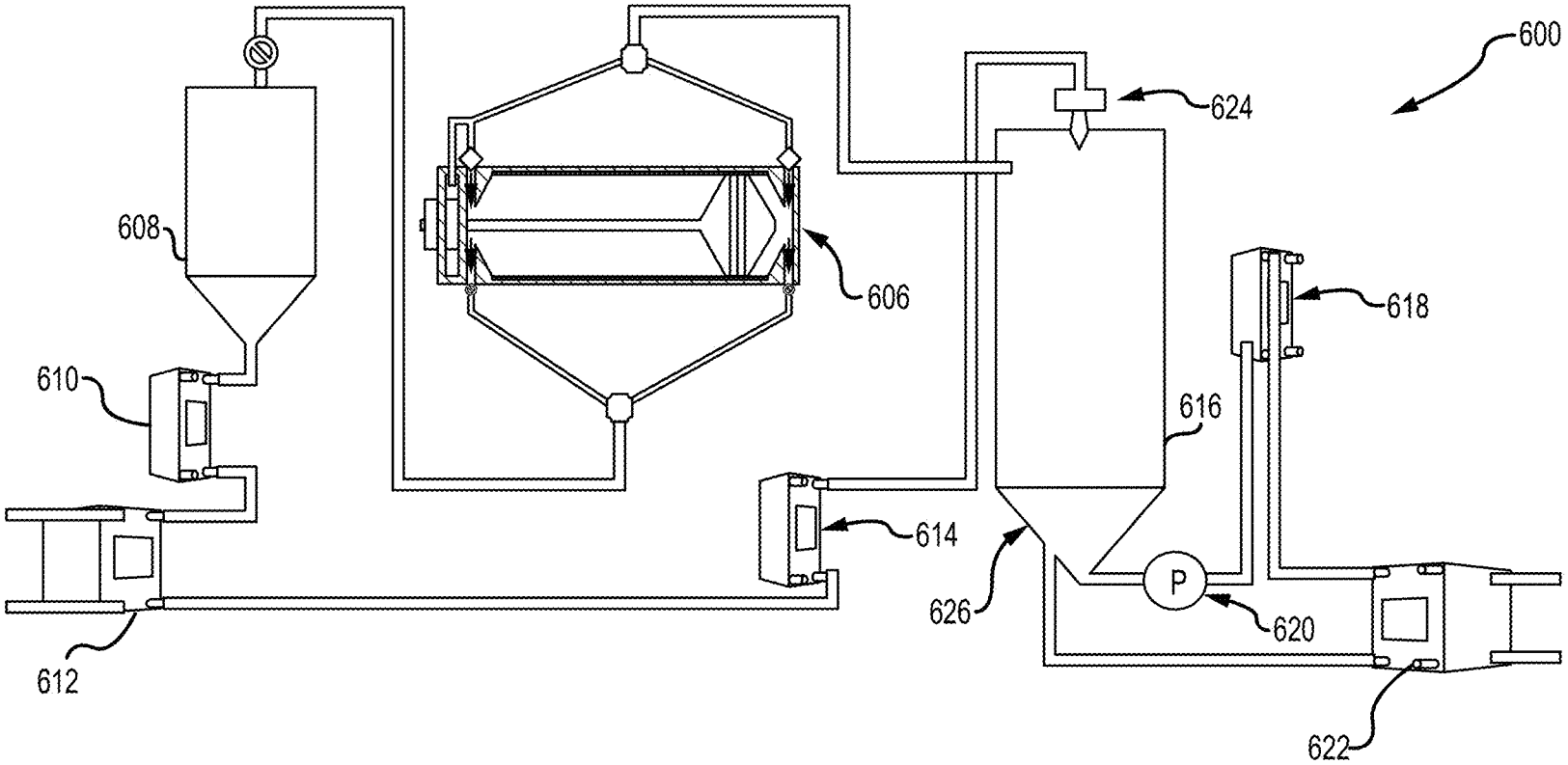
FIG. 6A illustrates a second circuit of the heat pump system shown in FIG. 1B.

FIG. 6A illustrates a second circuit 600 of the heat pump system 100 shown in FIG. 1B. The second circuit 600 illustrates the refrigerant 1234yf cycle that makes up the heat pump. Second circuit 600 can include a gaseous and liquid cycle that includes a 1234yf compressor 606, a hot tank 608, an evaporator 610 prior to a heat load 612, a preheater 614 downstream of the heat load 612 that leads to a cold gas expansion tank 616, a condenser 618 and a circulator pump 620 coupled to a cold load 622. In some examples, the 1234yf compressor 606 can take a 36 psi (248 KPa) 1234yf feed stream at about 35° F. (1.7° C.) and compress to a 325 psi (2.24 MPa) discharge pressure at about 170° F. (76.7° C.). The discharge stream can feed the hot tank 608 prior to entering the CO2 evaporator 610. In some examples, the CO2 evaporator 610 can be a 1 ton evaporator. In some examples, the hot tank 608 can be a 10 gallon tank at about 330 psi (2.28 MPa) and about 170° F. (76.7° C.) allowing for settling of liquid at the bottom of the tank(s) 608 for better heat transfer in the heat exchangers or heat load 612. In some examples, the CO2 evaporator 610 can be the same evaporator 110 discussed above with first circuit. The evaporator 610 can be configured to discharge to the heat load 612, where heat can be withdrawn from the heat pump system 100. In some embodiments, the heat load 612 can reduce the temperature of the stream to about 160° F. (71.1° C.) prior to being fed to the preheater 614. The heat load 612 can include a 5 ton heat exchanger for heating water, in some examples, however the size of the heat exchanger should not be considered to be limiting.

The preheater 614 can be the same preheater 220 used prior to the recuperator 206 discussed in FIG. 2 above, which is used to reclaim heat energy from second circuit 600. The 1234yf stream exits the preheater 614 at about 120° F. (48.9° C.) and about 325 psi (2.24 MPa). This exit stream feeds into the cold gas expansion tank 616 via an adjustable needle valve 624 or a thermal expansion valve in order to control and enhance condensing in the R-1234yf expansion tank 616.

In some examples, the preheater exit stream can be configured to flow through the adjustable needle valve 624 and/or a pressure relief valve configured to reduce the pressure from the preheater exit stream from about 325 psi (2.24 MPa) to about 36 psi (248.2 KPa). In some examples, the 1234yf stream can then flow into the cold gas expansion tank 616 that collects condensed liquid for a liquid-to-liquid cooling in first circuit and for external liquid cooling via liquid-to-liquid heat exchangers or liquid-to-air heat exchangers. In some examples, the cold gas expansion tank 616 can be about 20 gallons (75.7 L) in order to collect a liquid from about 10% to about 40% and vapor from about 90% to about 60% (by volume percentage) and can operate at about 35° F. (1.7° C.) and about 36 psi (248.2 KPa). The discharge of the cold gas expansion tank 616 can include a condensing cone 626 where the 1234yf vapor is condensed into a liquid at 36 psi (248.2 KPa) and about 35° F. (1.7° C.). In some examples, the liquid 1234yf can then feed into a 5 ton heat exchanger 622 for the AC load and/or cooling load. The discharge of the heat exchanger 622 and/or cooling load is fed into the CO2 condenser 618 and then pumped back into the cold gas expansion tank 616 via the circulator pump 620. In some examples, the pump 620 can include a 300 watt circulating pump 620 or the liquid may circulate by convection. In the expansion tank 616, the 1234yf can form a vapor that is discharged back to the suction side of the 1234yf linear piston compressor 606 at about 36 psi (248.2 KPa) and about 35° F. (1.7° C.) to complete the cycle.

Figure 6B:
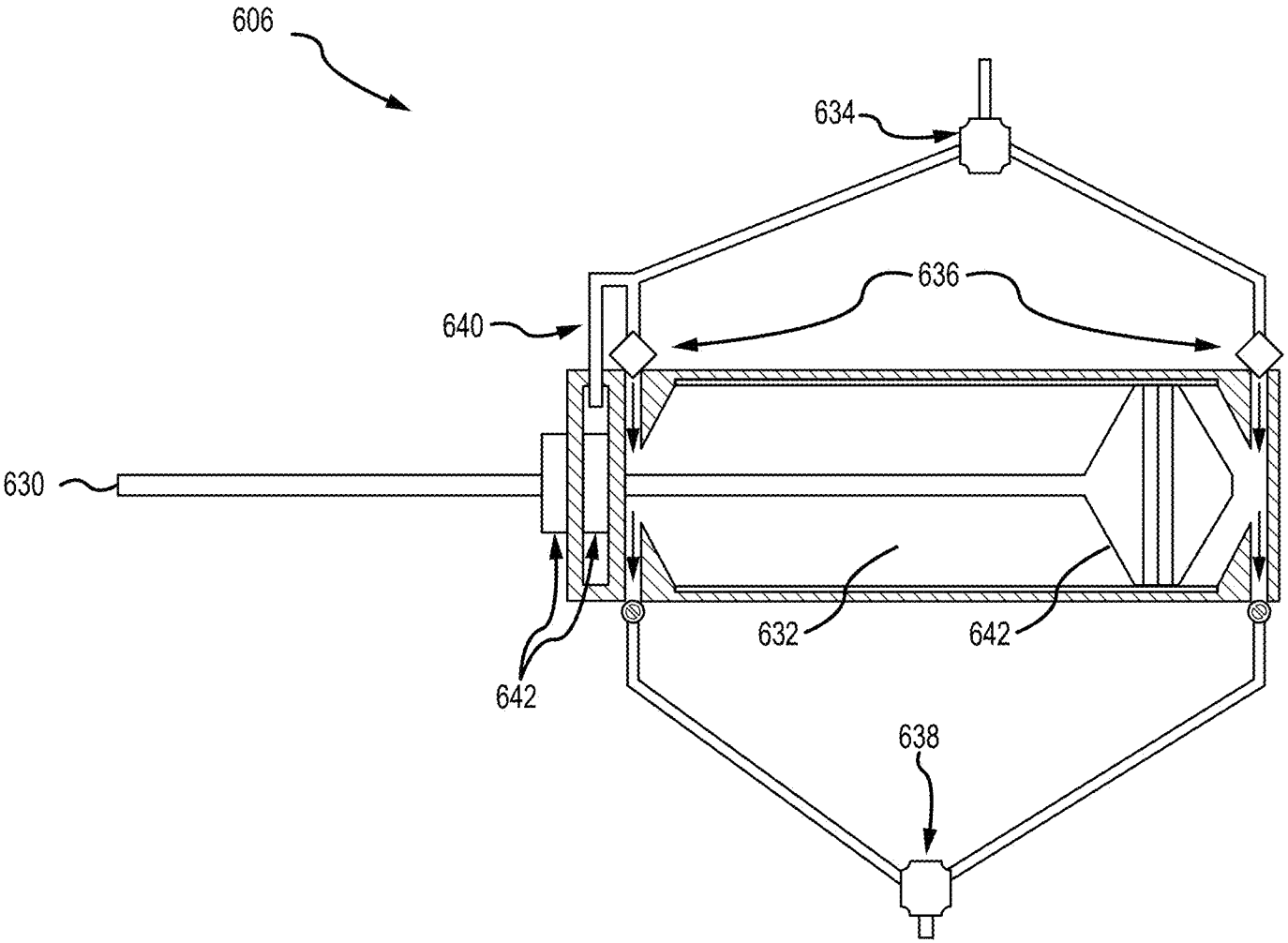
FIG. 6B illustrates a compressor of the second circuit shown in FIG. 6A.

FIG. 6B illustrates the compressor 606 of the second circuit shown in FIG. 6A. In some examples, the 1234yf compressor 606 can be configured to increases the pressure of the 1234yf from about 36 psi (248.2 KPa) to about 325 psi (2.24 MPa). The compressor 606 can be configured to operate at between about 37 to about 120 cycles per minute. The compressor 606 can be a linear motion piston pump. The pump can produce about 14,994 pounds of force. In some examples, the piston pump can be coupled to a shaft 630, which is directly linked to the CO2 gas vapor pressure force piston chamber as discussed in reference to FIG. 7 below. In some examples, within CO2 first circuit, the pressure of the CO2 ranges from about 1840 psi (12.69 MPa) at the dual piston chambers inlet to 597 psi (4.12 MPa) at the outlet which provides 1243 psi (8.57 MPa) or about 1250 psi (ΔP) of differential pressure force available for compressing the low pressure non-critical R-1234yf refrigerant vapor in second circuit 600.

In some examples, the compressor 606 can include about an eight inch chamber 632 housing the piston. The 1234yf refrigerant can enter the compressor 606 as a low pressure suction gas at about 36 psi (248.2 KPa). The gas can enter through a 3-way valve 634 or solenoid. In some examples, the 3-way valve 634 can include a stepper motor. In some examples, the gas is then pass through a check valve 636 prior to entering the piston chamber 632. The check valve 636 can be a 1 inch (2.54 cm) check valve, in some examples. The high pressure 1234yf gas can then exit the chamber 632 through a second 3-way valve or solenoid 638. The second 3-way valve 638 can also include a stepper motor. Upon exiting the second 3-way valve, the 1234yf gas is at a high pressure at 325 psi (2.24 MPa) and at a higher temperature of about 170° F. (76.7° C.).

The compressor 606 can also include a primary seal leakage bypass line 640 to bypass the 1 inch check valve 636, in some examples. The piston 642 is coupled to the shaft 630 that includes at least two linear mechanical seals 642 to seal the 8 inch chamber. The compressor 606 can be configured to generate a net extra force on vapor compression. In some examples, for a 1234yf gas refrigerant, the compressor 606 can operate with about a 289 psi (1.99 MPa) differential pressure and about 14,994 pounds of force that translates in 1.62 seconds per revolution. The compressor 606 can generate about 12,415 watts in the vapor.

Figure 7:
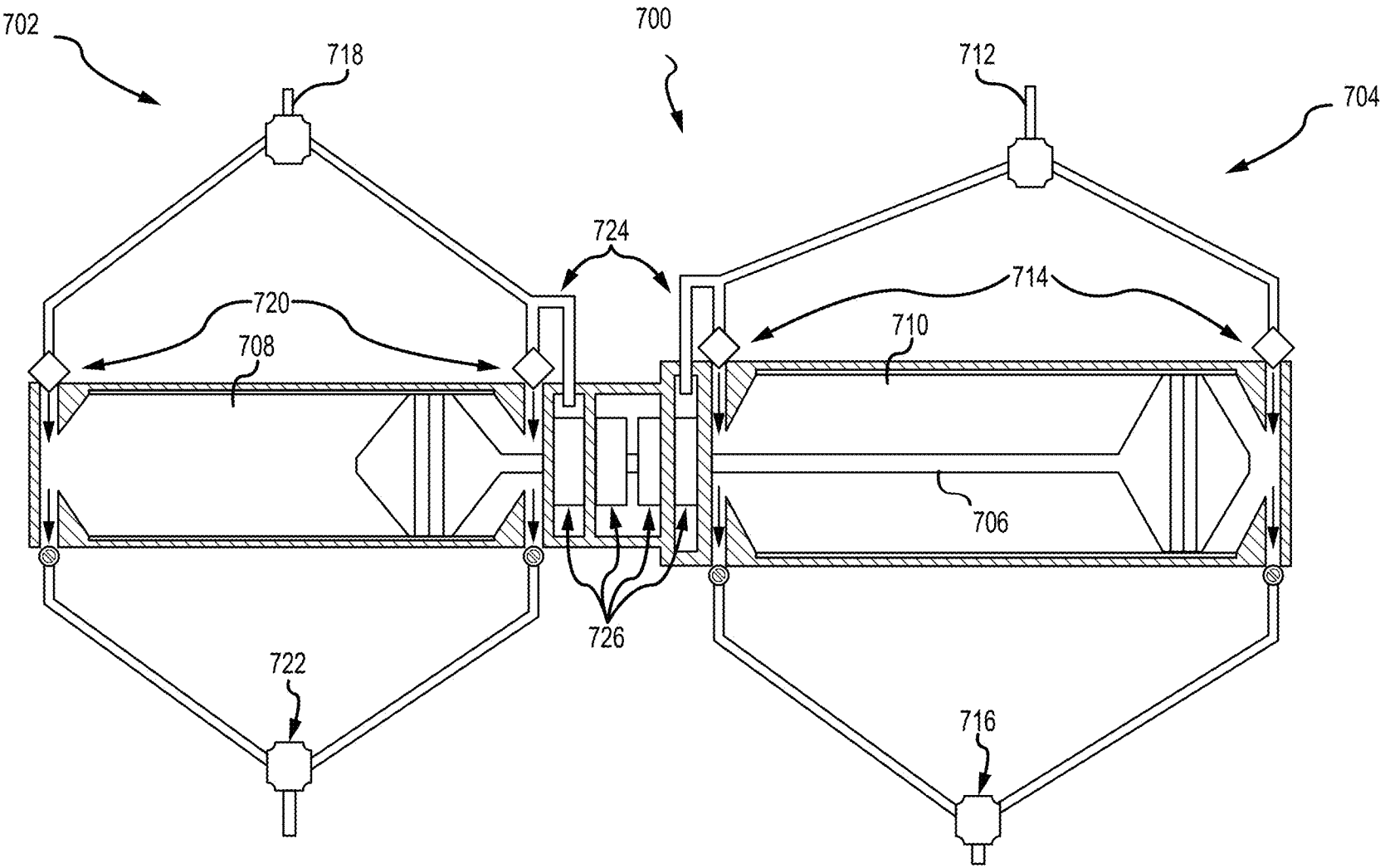
FIG. 7 illustrates a linked system including the carbon dioxide vapor pressure force power and heat pump piston chambers for the first circuit and the second circuit of the heat pump system shown in FIG. 1B.

Referring now to FIG. 7, the CO2 power and 1234yf heat pump piston chambers can be linked together. In other words, the CO2 gas linear piston compressor 702 and the 1234yf gas linear piston compressor 704 can share the same shaft 706 to operate the heat pump system in a linked shaft system 700. As such, the net extra force on the vapor compression of about 21,053 pounds (93 kN), or the difference in force between the two compressors can move the eight inch piston in second circuit about 1 foot (30.5 cm) in about 1.62 seconds per revolution. Inasmuch as the CO2 chamber 708 has greater vapor pressure than the R-1234yf chamber 710, the primary power in the linked shaft system 700 is the CO2 vapor-fired chamber force. The system 700 can be configured to produce 17,443 watts to move about 6 tons of heat in the vapor system. Because CO2 boils at −108° F. (−77.8° C.) but can only be in liquid phase at below 87° F. (30.6° C.), when it expands to a critical vapor at 140° F. (60° C.), it has a higher vapor pressure volume power increase at a closer change in temperature than the low pressure refrigerants such as 1234yf refrigerant. For the CO2 power cycle first circuit, operating at 53° F. (11.7° C.) above its critical state of 87° F. (30.6° C.) at a critical temperature of 140° F. (60° C.) and 1,840 psi (12.69 MPa) yields more pressure using less mass. For the heat pump cycle second circuit, operating at 32° F. (0° C.) below its critical state of 202° F. (94.4° C.) at a temperature of 170° F. (76.7° C.) and 325 psi (2.24 MPa) yields more mass, thus moving more heat, using less pressure.

Each fluid from the respective circuit, first circuit and second circuit can enter the compression chamber through a three-way valve. For example, the 1234yf refrigerant gas can enter through a 3-way valve 712 or solenoid. In some examples, the 3-way valve 712 can include a stepper motor. In some examples, the gas is then pass through a check valve 714 prior to entering the piston chamber 710. The check valve 714 can be a 1 inch (2.54 cm) check valve, in some examples. The high pressure 1234yf gas can then exit the chamber 710 through a second 3-way valve or solenoid 716. The second 3-way valve 716 can also include a stepper motor. Upon exiting the second 3-way valve, the 1234yf gas is at a high pressure at 325 psi and at a higher temperature of about 170° F.

Likewise, in some examples, the vapor pressure force piston chamber 708 can include the CO2 chamber 708, which can be about a six inch chamber housing the piston. The CO2 refrigerant can enter the vapor pressure force piston chamber 708 as a superheated-supercritical high pressure gas at between 800-2000 psi (5.5-13.8 MPa). The gas can enter through a 3-way valve or an electrical solenoid 718. In some examples, the 3-way valve 718 can include a stepper motor. In some examples, the gas can then pass through a check valve 720 prior to entering the piston chamber 702. The check valve 720 can be a ¾ in (1.9 cm) check valve, in some examples. The high pressure CO2 gas can then exit the chamber through a second 3-way valve 722. The second 3-way valve 722 can also include a stepper motor. Upon exiting the second 3-way valve 722, the CO2 gas is at a lower pressure, such as about 597 psi (4.12 MPa), because of a pressure drop from CO2 gas expansion, cooling and condensing at the outlet of the piston chamber 708.

Each of the piston chambers 708 and 710 can also include a primary seal leakage bypass line 724 to bypass the check valve 714 and 720, respectively, in some examples. The pistons can be coupled to the shaft 706 that includes linear mechanical seals 726 to seal the chambers 708 and 710 from each other. In some examples, the shaft 706 includes a magnetic coupling between a first piston disposed within the CO2 gas linear piston compressor and a second piston disposed within the 1234yf gas linear piston compressor, linking the pistons together with a single shaft 706.

Figure 8:
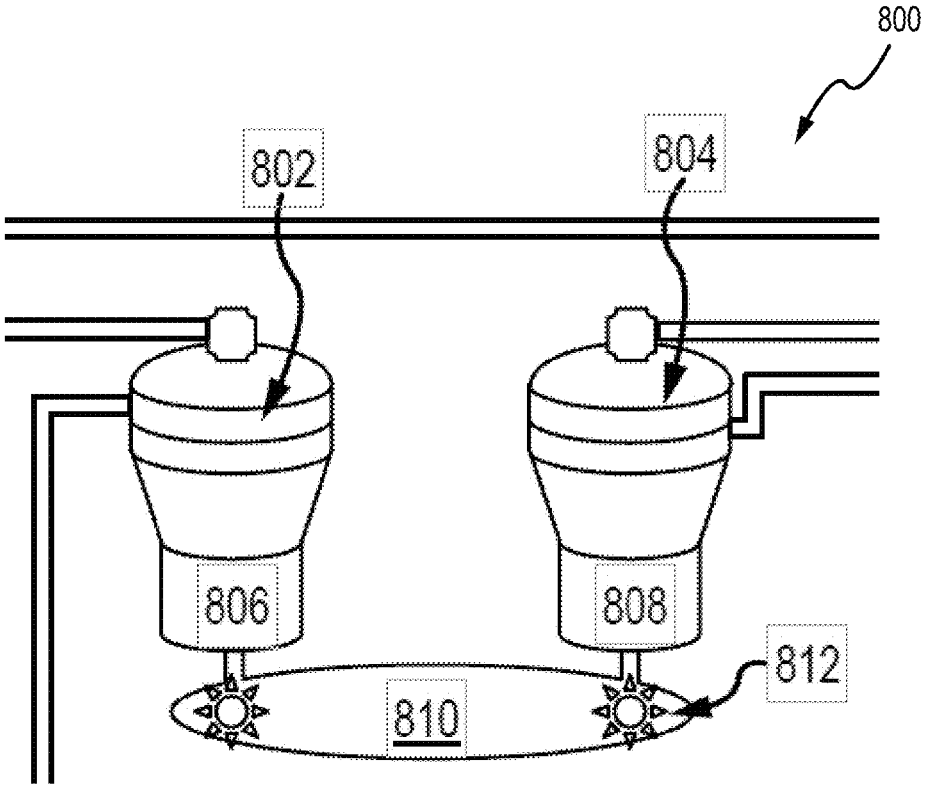
FIG. 8 illustrates a linked system including the carbon dioxide vapor pressure force power and heat pump piston chambers for the first circuit and the second circuit of the heat pump system shown in FIG. 1B connected together with a magnetic coupling and a gear, according to an embodiment.

Referring now to FIG. 8, the heat pump system 800 can include a CO2 decompression system 802 and a 1234yf compression system 804. FIG. 8 illustrates just the portion of the heat pump system including the decompression system 802 and the compression system 804. In some examples, the decompression system 802 and the compression system 804 include a first pressure shell 806 for the decompression system 802 and a second pressure shell 808 for the compression system 804. The decompression system 802 and the compression system 804 can be connected together with a magnetic coupling 810 and a gear 812. In some examples, the gear 812 further includes a belt or a chain. In other words, in place of the vapor pressure force piston chamber and/or linear pistons discussed above with respect to systems 100, 200, and 600, the heat pump system can CO2 decompression system 802 and a 1234yf compression system 804 utilizing scroll compressors.

In some examples, the gear 812 includes a decompressor including a first scroll compressor 806, the decompression system 802 including a high-pressure refrigerant. A scroll compressor is a type of compressor that uses two interlaced spiral metal pieces (or scrolls) instead of pistons to compress the refrigerant. The scroll compressor works by using a pair of scroll-shaped elements, with one scroll orbiting within the other scroll. Scroll compressors operate by compressing refrigerant through a moving scroll in a smooth, spiral motion. As the refrigerant passes toward the center of the scroll, increasingly smaller pockets of refrigerant are created that gradually rise in temperature and pressure. With only a few moving parts, scroll compressors are quieter and more energy efficient than conventional compressors. Less moving parts also make for a more durable operation with fewer breakdowns.

In some examples, the compression system 804 includes a system where the high-pressure refrigerant (e.g., R-1234yf) drives a second compressor comprising a second scroll compressor 808, the compression system 804 including a low pressure refrigerant. In some examples, the decompression system 802 connected to the compression system 804 is configured to transfer energy from the decompression system 802 to the compression system 804. In some examples, the he high-pressure refrigerant includes carbon dioxide and the low-pressure refrigerant includes R-1234yf.

Figure 9:
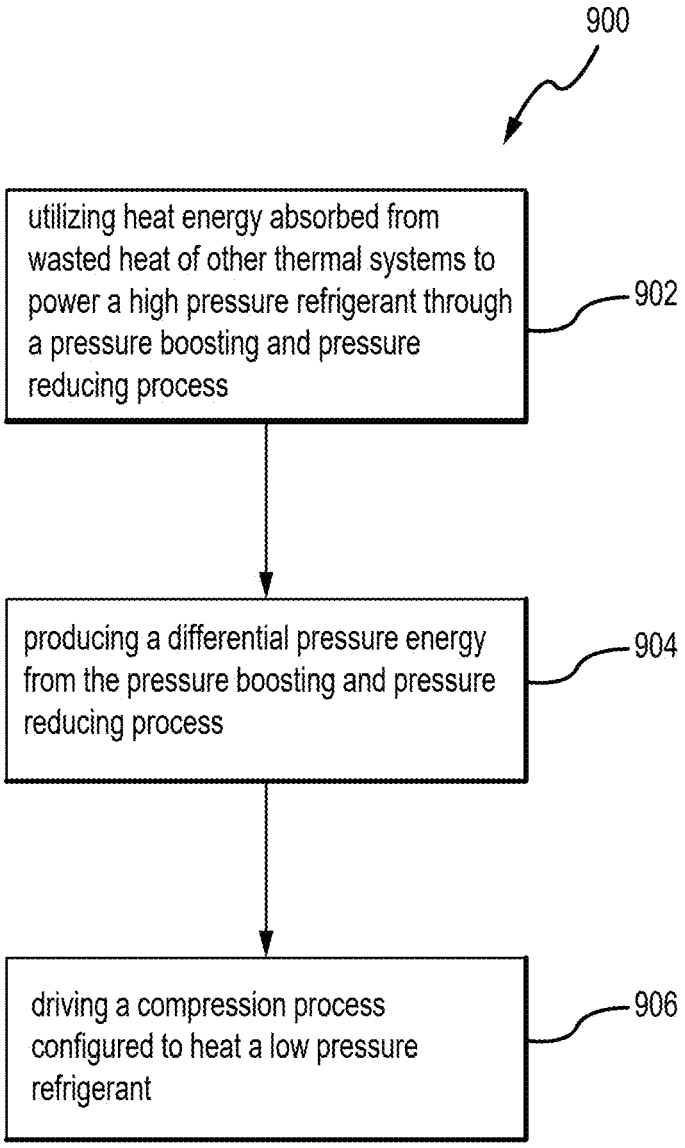
FIG. 9 illustrates a flow chart of a method of operating a heat pump system, according to an embodiment.

FIG. 9 illustrates a method 900 of operating a heat pump system, according to an embodiment. In some examples, the method 900 can include an act 902 of utilizing heat energy absorbed from wasted heat of other thermal systems to power a high pressure refrigerant through a pressure boosting and pressure reducing process. In some examples, the waste heat can be drawn from an exterior environment. In some examples, the pressure boosting and pressure reducing process comprises an evaporation and condensing the high pressure refrigerant. In some examples, the method 900 can further include an act 904 including producing a differential pressure energy from the pressure boosting and pressure reducing process.

In some examples, the method 900 can further include an act 906 of driving a compression process configured to heat a low pressure refrigerant. In some examples, the other thermal systems can include at least one of a vehicle engine, a vehicle exhaust system, a vehicle radiator, a chiller, a generator, a heat pump, a boiler, a chimney, process waste heat, and geothermal waste heat. However, other sources of outside heat can be included. In some examples, the high pressure refrigerant can include carbon dioxide and the low pressure refrigerant can include R-1234yf. In at least one example, the method 900 can include utilizing engine heat from a generator to chill or freeze a containment or building space including pumping heat to a space adding air conditioning and heating to the same space without drawing additional electricity from the fuel engine.

Figure 10:
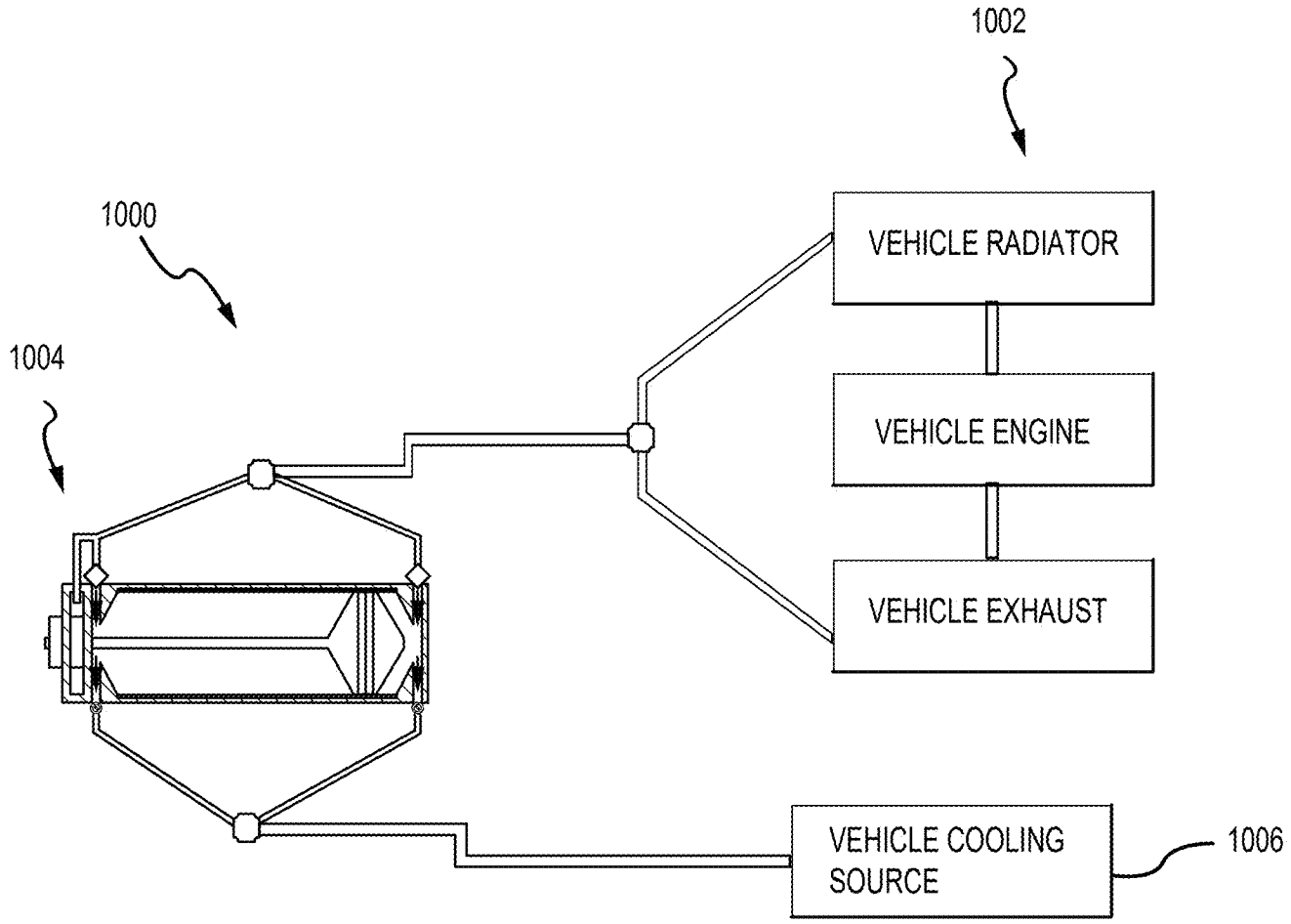
FIG. 10 illustrates a heat pump system, according to an embodiment.

FIG. 10 illustrates a heat pump system 1000 that can be incorporated into a vehicle, in some embodiments. In some examples, the heat pump system 1000 can include a vehicle heat source 1002. In some examples, the vehicle heat source 1002 can include the vehicle radiator, the vehicle engine, and/or the vehicle exhaust system, however, other heat sources can be included. In some examples, the heat pump system 1000 can further include a dual circuit heat pump 1004. The dual circuit heat pump 1004 can include a first circuit (detail not shown) having a first refrigerant. In some examples, the first circuit can operate on the same principles and include the same components of the first circuit of the heat pump system 100 shown in FIG. 1B. In some examples, the first circuit can include a first refrigerant. In at least one example, the first refrigerant can include CO2.

In some examples, the heat pump system 1000 includes a second circuit (not shown) that includes a second refrigerant. In some examples, the second refrigerant can include R-1234yf. The second circuit can be configured to extract thermal energy from the first circuit. The first circuit and the second circuit are configured in a mechanical relationship for transferring energy from the first circuit to the second circuit. In some examples, the energy transfer can include a phase change of the first refrigerant through the dual circuit heat pump 1004, the first circuit including a non-mechanical phase liquid to high critical vapor fluid phase.

For example, a vehicle can include a semi-truck. The heat pump system 1000 can utilize waste heat from the truck energy system such as the radiator, the engine, and/or the exhaust system. In some examples, the waste heat can be converted to electrical energy so that low energy fuel circuit heat pumping for refrigeration can be maintained for a period when the semi-truck engine is not operating. In other examples, the heat pump system 1000 can convert a relatively cool energy source to a colder condition, when the heat pump system 1000 is configured for such an energy transfer. For example, a vehicle cooling source 1006 can include cool ambient flowing air to cool semi-truck refrigerated cargo. In some examples, the heat pump system 1000 can utilize waste heat and or cooling from an engine or vehicle to operate the dual circuit heat pump system 1000. Other examples can include transferring heat to heat and cool the inside of a vehicle. In some examples, the heat pump system 1000 can be configured to convert the heat energy from the vehicle to mechanical work. For example, the heat pump system 1000 can be configured to take the waste heat from the vehicle heat source 1002 to add mechanical energy to the vehicle's or combustion engine drivetrain. In some examples, a portion of the waste heat from the vehicle heat source 1002 can be used to heat and cool the inside of a vehicle in addition to adding mechanical energy to a vehicle or engine.

Figure 11:
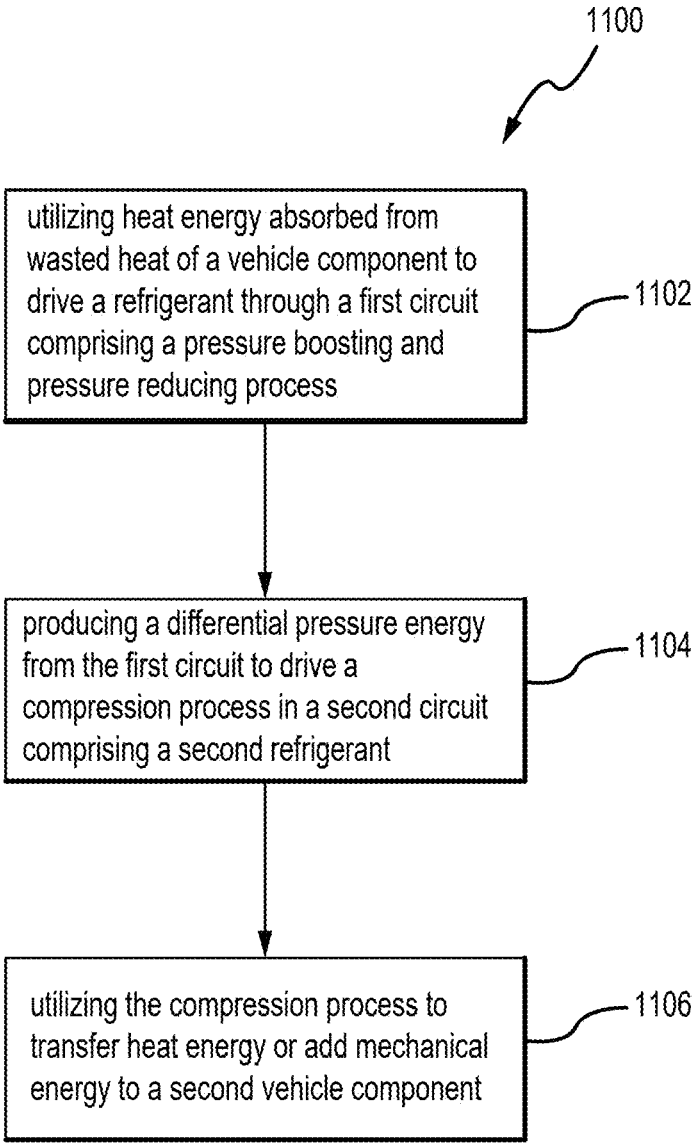
FIG. 11 illustrates a flow chart of a method of operating a heat pump system, according to an embodiment.

FIG. 11 illustrates a flow chart of a method 1100 of operating a heat pump system, according to an embodiment. In some examples, the method 1100 can include an act 1102 of utilizing heat energy absorbed from wasted heat of a vehicle component to drive a refrigerant through a first circuit comprising a pressure boosting and pressure reducing process. In some examples, the waste heat can be drawn from at one of the vehicle's exhaust system, the engine system, or the radiator. In some examples, the pressure boosting and pressure reducing process comprises an evaporation and condensing the refrigerant in the first circuit. In some examples, the method 1100 can further include an act 1104 including producing a differential pressure energy from the first circuit to drive a compression process in a second circuit that includes a second refrigerant.

In some examples, the method 1100 can further include an act 1106 of utilizing the compression process to transfer heat or add mechanical energy to a second vehicle component such as the drivetrain of a vehicle or engine. However, other sources of outside heat can be included. For example, in some examples, a vehicle can utilize the dual circuit heat pump system to take waste heat from a truck engine system to air condition the vehicle interior or to cool refrigerated or frozen cargo being transported on the truck. In other examples, a heat pump system can utilize a vehicle's waste heat to charge the vehicle's batteries or otherwise control the temperature of one or more compartments in the vehicle (e.g., cab or trailer). As such, a low energy fuel circuit heat pumping for refrigeration of cargo can be maintained for periods when the vehicle's engine is not operating, such as at rest areas or when the trucker is sleeping. The above examples do not utilize additional electricity to be carried out. In some examples, the first refrigerant can include carbon dioxide and the second refrigerant can include R-1234yf.

While the system 1000 and method 100 are described with respect to a vehicle and engine thereof, it should be understood that the system 1000 and method 1100 may be used with engines or motors generally. For example, the system 1000 may include an engine, a radiator of the engine, and an engine exhaust, such as on a generator motor, a drill motor, or the like. the engine, radiator, and exhaust can be used in concert with a heat pump system to utilizing engine heat from a generator to chill or freeze a containment or building space. For example, such a use can include pumping heat to a space adding air conditioning and heating to the same space without drawing additional electricity from the engine.

While various aspects and embodiments have been disclosed herein, other aspects and embodiments are contemplated. The various aspects and embodiments disclosed herein are for purposes of illustration and are not intended to be limiting.

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, etc.

The term "set" generally means a grouping of one or more elements. The elements of a set do not necessarily need to have any characteristics in common or otherwise belong together. The phrase "at least one of A, B, and C" should be construed to mean a logical (A OR B OR C), using a non-exclusive logical OR, and should not be construed to mean "at least one of A, at least one of B, and at least one of C." The phrase "at least one of A, B, or C" should be construed to mean a logical (A OR B OR C), using a non-exclusive logical OR. The phrase "A, B, and/or C" should be construed in the same way as the phrase "at least one of A, B, and C."

The invention claimed is:

1. A heat pump system comprising:

a first circuit, including a first refrigerant, configured to cycle a non-mechanical liquid to high critical vapor fluid phase in a closed circuit from an evaporator to an outlet of a liquid pump; and a second circuit including a second refrigerant, wherein:

the second circuit is configured to extract thermal energy from the first circuit to produce a heated fluid and a cooled fluid, the first circuit and the second circuit are configured in a mechanical relationship for transferring energy from the first circuit to the second circuit via a phase change of the first refrigerant through a dual-chambered heat pump, the first circuit includes the non-mechanical liquid phase to high critical vapor fluid phase cycle, the second circuit includes one or more vapor pumps, the one or more vapor pumps includes a linear motion piston pump, the one or more vapor pumps includes a discharge having about 325 psi and about 170° F., the linear motion piston pump includes an integrated alternating pole DC piston motor having a piston and a stator, the piston includes neodymium magnets disposed thereon, and the stator includes copper windings embedded in a Teflon sleeve disposed in a chamber wall of the integrated alternating pole DC piston motor to produce electricity as parallel work to vapor compression performed by the linear motion piston pump.

2. The heat pump system of claim 1 wherein the first refrigerant includes at least one of: carbon dioxide or nitrogen.

3. The heat pump system of claim 1 wherein the first refrigerant includes a refrigerant with a boiling point below −30° C.

4. The heat pump system of claim 1 wherein the second refrigerant includes at least one of: a 1234yf refrigerant or a 1234ze refrigerant.

5. The heat pump system of claim 1 wherein the second refrigerant includes a refrigerant with a boiling point above −30° C.

6. The heat pump system of claim 1 wherein:

the first circuit includes one or more liquid pumps, and the one or more liquid pumps includes a discharge having about 1,840 psi and about 45° F.

7. The heat pump system of claim 1 wherein the first circuit includes a start-up compressor configured to initiate the heat pump system.

8. The heat pump system of claim 1 further comprising a heat exchanger, wherein:

the heat exchanger includes a non-mechanical booster pump including a first configuration and a second configuration, the first configuration includes the non-mechanical booster pump as an evaporator adapted to absorb thermal energy from a structure in a cooling mode, and the second configuration includes the non-mechanical booster pump as a condenser adapted to supply thermal energy to the structure in a heating mode.

9. The heat pump system of claim 1 wherein the first circuit is configured to draw waste heat from an exterior environment.

10. The heat pump system of claim 1 further comprising a recuperator to reclaim heat energy from the second circuit.

11. A heat pump system comprising:

a first circuit, including a first refrigerant, configured to cycle a non-mechanical liquid to high critical vapor fluid phase in a closed circuit from an evaporator to an outlet of a liquid pump;

a second circuit including a second refrigerant, wherein:

the second circuit is configured to extract thermal energy from the first circuit to produce a heated fluid and a cooled fluid, the first circuit and the second circuit are configured in a mechanical relationship for transferring energy from the first circuit to the second circuit via a phase change of the first refrigerant through a dual-chambered heat pump, and the first circuit includes the non-mechanical liquid phase to high critical vapor fluid phase cycle; and a heat exchanger, wherein:

the heat exchanger includes a non-mechanical booster pump including a first configuration and a second configuration, the first configuration includes the non-mechanical booster pump as an evaporator adapted to absorb thermal energy from a structure in a cooling mode, and the second configuration includes the non-mechanical booster pump as a condenser adapted to supply thermal energy to the structure in a heating mode.

12. The heat pump system of claim 11 wherein the first refrigerant includes at least one of: carbon dioxide or nitrogen.

13. The heat pump system of claim 11 wherein the first refrigerant includes a refrigerant with a boiling point below −30° C.

14. The heat pump system of claim 11 wherein the second refrigerant includes at least one of: a 1234yf refrigerant or a 1234ze refrigerant.

15. The heat pump system of claim 11 wherein the second refrigerant includes a refrigerant with a boiling point above −30° C.

16. The heat pump system of claim 11 wherein:

the first circuit includes one or more liquid pumps, and the one or more liquid pumps includes a discharge having about 1,840 psi and about 45° F.

17. The heat pump system of claim 11 wherein:

the second circuit includes a vapor pump having a linear motion piston pump, and the vapor pump includes a discharge having about 325 psi and about 170° F.

18. The heat pump system of claim 11 wherein the first circuit includes a start-up compressor configured to initiate the heat pump system.

19. The heat pump system of claim 11 wherein the first circuit is configured to draw waste heat from an exterior environment.

20. The heat pump system of claim 11 further comprising a recuperator configured to reclaim heat energy from the second circuit.

* * * * *